United States Patent [19]

King

[11] 4,385,868

[45] * May 31, 1983

[54] SYSTEMS FOR EVACUATING PROCESS FLUIDS HAVING CONDENSABLE AND INCONDENSABLE COMPONENTS

[75] Inventor: Stephen J. King, Clearwater, Fla.

[73] Assignee: Nash Engineering Company, Norwalk, Conn.

[ * ] Notice: The portion of the term of this patent subsequent to Feb. 16, 1999, has been disclaimed.

[21] Appl. No.: 181,463

[22] Filed: Aug. 26, 1980

Related U.S. Application Data

[63] Continuation-in-part of Ser. No. 95,760, Nov. 19, 1979, Pat. No. 4,315,717.

[51] Int. Cl.[3] ..... F04C 19/00

[52] U.S. Cl. ..... 417/69; 417/87; 417/250

[58] Field of Search ..... 417/68, 69, 87, 244, 417/250, 153

[56] References Cited

U.S. PATENT DOCUMENTS

| | | | |
|---|---|---|---|
| 1,991,548 | 2/1935 | DeMotte | 417/68 |
| 3,315,879 | 4/1967 | Jennings | 417/69 X |
| 3,481,529 | 12/1969 | Mugele | 417/69 X |
| 3,575,532 | 4/1971 | Mugele et al. | 417/69 |
| 4,315,717 | 2/1982 | King | 417/69 |

*Primary Examiner*—Edward K. Look

*Attorney, Agent, or Firm*—Robert R. Jackson; David W. Plant

[57] ABSTRACT

Systems for evacuating process fluids having condensable and incondensable components, especially those including corrosive constituents, include a condenser for condensing at least part of the condensable component and discharging the condensate from the system, a jet diffuser supplied with atmospheric air as a motivating fluid for diluting and increasing the pressure of the uncondensed portion of the process fluid, and a liquid ring suction pump for further increasing the pressure of the diluted uncondensed process fluid and discharging it from the system.

7 Claims, 3 Drawing Figures

SYSTEMS FOR EVACUATING PROCESS FLUIDS HAVING CONDENSABLE AND INCONDENSABLE COMPONENTS

This application is a continuation-in-part of application Ser. No. 95,760, filed Nov. 19, 1979 now U.S. Pat. No. 4,315,717.

BACKGROUND OF THE INVENTION

This invention relates to process fluid evacuation systems, and more particularly to systems including liquid ring pumps for evacuating process fluids having condensable and incondensable components. As used herein and in the appended claims, "condense" and its variants refer to conversion from a gaseous to a liquid state; "incondensable" refers to vapors or gases which cannot be converted to a liquid state under the conditions normally found in the systems of this invention; and "uncondensed" refers to vapors or gases which are incondensable, and which may also include condensable materials which have not yet condensed.

A liquid ring pump system for evacuating process fluid having condensable and incondensable components is shown in Jennings U.S. Pat. No. 3,315,879. As shown, for example, in FIG. 1 of that patent, suction for operating the evacuation system is supplied by liquid ring pump 1. The process fluid to be evacuated is supplied to condenser 20 via conduit 21. In condenser 20 the process fluid is mixed with condensing liquid supplied from heat exchanger 19 via conduit 26. The condensate and condensing liquid exit from condenser 20 via conduit 29 and are supplied to the suction inlet of liquid ring pump 1. The incondensable remainder of the process fluid exits from condenser 20 via conduit 15 and is supplied to the inlet of jet diffuser 10.

Motivating fluid for jet diffuser 10 is a recirculated portion of the evacuated process fluid supplied at atmospheric pressure from separator 5 via conduit 16. Jet diffuser 10 mixes the process fluid with the motivating fluid to increase the pressure of the process fluid to a suitable suction inlet pressure for liquid ring pump 1. The mixture of process fluid and motivating fluid produced by jet diffuser 10 is supplied to the suction inlet of liquid ring pump 1 via conduit 8.

Liquid ring pump 1 compresses the fluid thus supplied to it and discharges the compressed fluid at approximately atmospheric pressure via conduit 6 to separator 5. Separator 5 separates the liquid and gaseous phases of the fluid supplied to it. A portion of the gaseous phase is recirculated to jet diffuser 10 as mentioned above, while the remainder of the gaseous phase is discharged to the atmosphere. The liquid phase is recirculated through heat exchanger 19 as condensing liquid for condenser 20 and as sealing liquid for liquid ring pump 1. The Jennings patent mentions (column 2, lines 56–58) that the condensing liquid and pump sealing liquid may be alternatively derived from outside sources.

The relatively closed-loop construction of the system described above can be undesirable when the process fluid being evacuated contains corrosive constituents because these constituents may build up or concentrate in the system, thereby reducing the life of the system components. An example of an application in which the process fluid contains corrosive constituents is evacuation of evaporators in phosphoric acid plants.

In view of the foregoing, it is an object of this invention to improve and simplify evacuation systems of the type described above, especially (but not exclusively) those designed for evacuating process fluids containing corrosive constituents.

SUMMARY OF THE INVENTION

This and other objects of the invention are accomplished in accordance with the principles of the invention by providing an improved system of the type described above in which the motivating fluid for the jet diffuser is atmospheric air rather than recirculated process fluid. In this way the process fluid is substantially diluted with atmospheric air in the jet diffuser and prior to the liquid ring pump, thereby substantially reducing the possibly corrosive effects of the process fluid. No part of the process fluid is recirculated as motivating fluid for the jet diffuser so that possibly corrosive constituents in the process fluid do not tend to build up in the system as the result of such recirculation.

The condenser in the system is preferably of the type which keeps the condensing fluid physically separate from the process fluid (for example, a shell and tube type condenser, a plate or spiral plate type condenser, an air-cooled radiator, or any other similar type of condenser). The process fluid condensate produced by the condenser is also preferably discharged from the system without passing through the liquid ring pump so that the liquid ring pump is not exposed to any possibly corrosive constituents in the condensate.

Further features of the invention, its nature and various advantages will be more apparent from the accompanying drawing and the following detailed description of the invention.

DETAILED DESCRIPTION OF THE INVENTION

Figure 1:
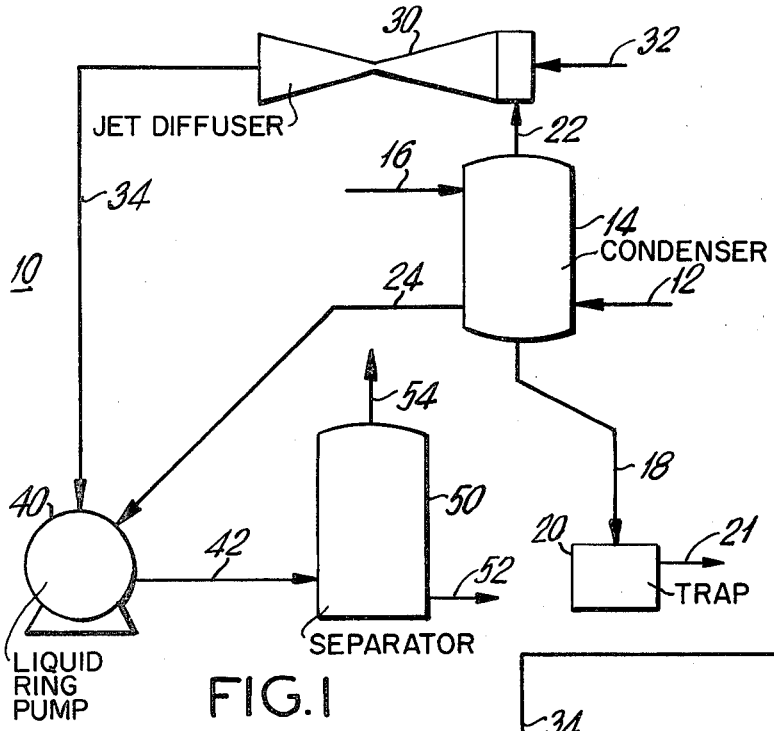
FIG. 1 is a simplified schematic flow diagram of an evacuation system constructed in accordance with the principles of the invention.

In the illustrative embodiment of the invention shown in FIG. 1, process fluid to be evacuated is supplied to evacuation system 10 via conduit 12. The process fluid passes through condenser 14 which is supplied with relatively cool condensing fluid via conduit 16. Condenser 14 is preferably of the type which keeps the process fluid physically separate from the condensing fluid. In the preferred embodiment shown in FIG. 1, condenser 14 is a shell and tube type condenser in which the condensing fluid is water supplied via conduit 16 from a source external to evacuation system 10. Condenser 14 could alternatively be a plate type condenser, a spiral plate type condenser, or any other similar type of condenser.

In condenser 14 at least part of the condensable component of the process fluid is condensed by heat exchange with the condensing fluid. The condensate exits from condenser 14 via conduit 18 to condensate trap or reservoir 20, from which the condensate is eventually discharged from the system via conduit 21. Conduit 18 and trap 20 prevent any condensate from returning to the system. For example, conduit 18 may comprise a barometric leg in which the surface of condensate is below the level of condenser 14. The condensing fluid passed through condenser 14 is supplied to liquid ring pump 40 via conduit 24 as seal liquid for the pump. Because condenser 14 keeps the condensing fluid separate from the process fluid, the condensing fluid is supplied to pump 40 substantially uncontaminated by any contact with the process fluid. Condenser 14 is preferably designed so that the condenser does not use any more condensing fluid than pump 40 can handle as seal liquid. The system therefore makes use of the condensing liquid twice: first as condensing liquid and then as pump seal liquid. This avoids the need for separate supplies of condensing liquid and pump seal liquid, which has important conservation and environmental advantages. Because many available liquid ring pumps are capable of handling seal liquid in excess of the normal minimum amount, the system is not limited to the normal seal liquid requirements of the pump, and more than that normal amount of liquid can be supplied to condenser 14 and passed through pump 40 if advantageous to the operation of condenser 14.

The uncondensed portion of the process fluid exits from condenser 14 via conduit 22 to jet diffuser 30. In jet diffuser 30, the uncondensed portion of the process fluid is mixed with atmospheric air supplied to the jet diffuser via conduit 32 as motivating fluid for the jet diffuser. Jet diffuser 30 thus dilutes the uncondensed process fluid with atmospheric air and increases the pressure of the diluted process fluid to the inlet or suction pressure of pump 40. Diluted process fluid from jet diffuser 30 is supplied to the suction inlet of pump 40 via conduit 34.

Pump 40 provides the suction pressure which drives the evacuation system. Pump 40 pumps the diluted process fluid from its suction inlet to its discharge outlet, and in so doing increases the pressure of the diluted process fluid from the relatively low suction inlet pressure to substantially atmospheric pressure at the discharge outlet. The process fluid and excess seal liquid discharged from pump 40 are conveyed to separator 50 via conduit 42. Separator 50 separates the liquid and gaseous phases of the fluid supplied to it, the liquid phase exiting from the system via conduit 52, and the gaseous phase exiting via conduit 54.

Because the motivating fluid for jet diffuser 30 is atmospheric air rather than recirculated process fluid as in the system shown in the above-mentioned Jennings patent, possibly corrosive constituents of the process fluid do not build up in the system. Accordingly, the system of this invention is better able to tolerate possibly corrosive process fluid constituents. The tolerance of the system to corrosive constituents is also enhanced by keeping the condensing fluid separate from the process fluid in condenser 14 and discharging the condensate from the system without allowing it to pass through the liquid ring pump as in the Jennings patent system. The use of condensing fluid and pump seal liquid from an external source rather than a recirculating system also prevents the accumulation of possibly corrosive constituents in the system. By removing at least a portion of the condensable component of the process fluid, condenser 14 reduces the mass and volume of process fluid which must be handled by jet diffuser 30 and pump 40. This may make it possible to reduce the size of these elements. For example, the size of jet diffuser 30 is basically determined by the mass per unit time interval of process fluid passing through it. By removing at least some of the condensable component of the process fluid prior to jet diffuser 30, the mass of process fluid per unit time interval supplied to jet diffuser 30 is reduced and the size of that element can be correspondingly reduced. Further, depending on the degree of reduction in the size of jet diffuser 30, the size of pump 40 may also be reduced and/or the horsepower required to operate pump 40 may be reduced. A horsepower reduction for pump 40 may result from being able to operate the pump at a lower speed, thereby improving the efficiency of the system.

Figure 2:
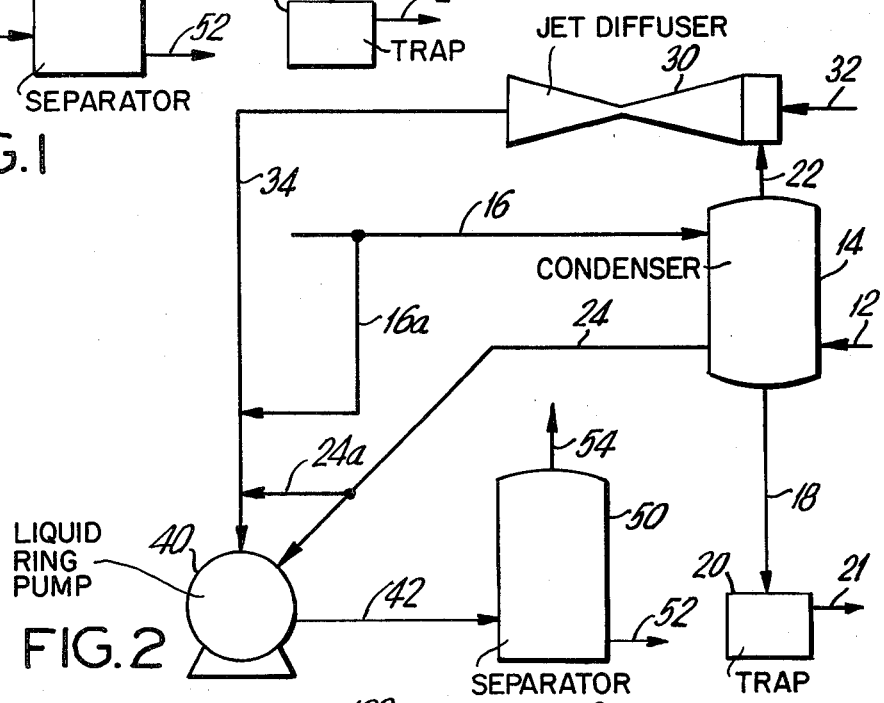
FIG. 2 is a simplified schematic flow diagram showing an alternative embodiment of the evacuation system of the invention.

The alternative embodiment shown in FIG. 2 is similar to the embodiment shown in FIG. 1, and elements identified by the same reference numbers in these two Figures are the same. The principal difference between these two embodiments is that in FIG. 2 some liquid from the condensing fluid supply is sprayed from conduit **16*a* into the diluted process fluid in conduit 34 prior to the suction inlet of liquid ring pump 40, and a portion of the condensing fluid exiting from condenser 14 via conduit 24 is similarly sprayed from conduit 24*a* into the process fluid in conduit 34 at a location intermediate the spray from conduit 16*a* and the suction inlet of pump 40. These sprays of condensing liquid promote further condensation of any remaining condensable component in the diluted process fluid prior to pump 40, thereby increasing the efficiency of the pump. Preferably, the total amount of condensing liquid supplied to the system via conduits 16 and 16*a* does not exceed the liquid capacity of pump 40. If desired, either conduit 16*a* or conduit 24*a* can be omitted. Also, the spray from either or both of conduits 16*a* and 24*a*** can be subdivided into separate sprays at two or more locations to further enhance the condensing efficiency of the sprays.

Figure 3:
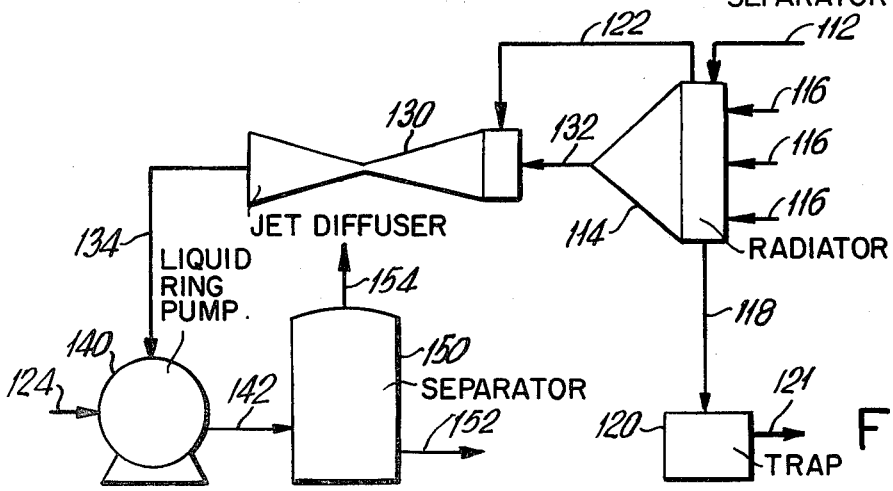
FIG. 3 is a simplified schematic flow diagram showing another alternative embodiment of the evacuation system of the invention.

The embodiment shown in FIG. 3 uses an air-cooled radiator rather than a liquid-cooled heat exchanger as a condenser. Process fluid to be evacuated is supplied to air-cooled radiator 114 via conduit 112. Atmospheric air for cooling radiator 114 is supplied via conduits 116. As in the previously described embodiments, radiator 114 keeps the cooling air physically separate from the process fluid. Radiator 114 condenses at least a portion of the condensable component of the process fluid. The condensate exits from radiator 114 via conduit 118 to reservoir or trap 120, from which the condensate is eventually discharged from the system via conduit 121. The uncondensed portion of the process fluid exits from radiator 114 and is supplied to the suction inlet of jet diffuser 130 via conduit 122. The atmospheric air used to cool radiator 114 is supplied as motivating fluid to jet diffuser 130 via conduit 132. If desired, the motivating fluid for jet diffuser 130 can be alternatively drawn directly from the atmosphere. In that event, it would be necessary to provide other means for producing a flow of cooling air through radiator 114. This could be a separate fan, or radiator 114 could be included in some other air intake system of the process involved.

The remainder of the evacuation system of FIG. 3 is similar to the previously described embodiments. Diluted uncondensed process fluid is supplied from jet diffuser 130 to liquid ring pump 140 via conduit 134. Seal liquid is supplied to pump 140, preferably from an external supply, via conduit 124. Process fluid and excess seal liquid discharged from pump 140 are conveyed to separator 150 via conduit 142. Separator 150 separates the liquid and gaseous phases of the fluid supplied to it, discharging the liquid phase via conduit 152 and the gaseous phase via conduit 154.

As in the previously described embodiments, in the system shown in FIG. 3 the use of atmospheric air rather than recirculated process fluid as the motivating fluid for jet diffuser 130 prevents the build-up of possibly corrosive constituents in the system. The immediate discharge from the system of the process fluid condensate produced by radiator 114 also eliminates other possible corrosives from the system at an early stage. And the use of pump seal liquid from an external supply rather than a recirculating system further prevents accumulation of possibly corrosive constituents in the system.

It will be understood that the embodiments shown and described herein are merely illustrative of the principles of the invention, and that various modifications may be made by those skilled in the art without departing from the scope and spirit of the invention. For example, a portion of the liquid from conduit 124 in FIG. 3 can be sprayed into the diluted process fluid in conduit 134, if desired, in the manner shown in FIG. 2.

What is claimed is:

1. A system for evacuating process fluid from a process fluid source, the process fluid having condensable and incondensable components comprising:

a source of condensing fluid at a temperature substantially lower than the temperature of the process fluid at the process fluid source;

condenser means for condensing at least a portion of the condensable component of the process fluid by heat exchange with the condensing fluid while keeping the process fluid and the condensing fluid physically separate from one another, the condenser means having a process fluid inlet connected to the process fluid source, a condensing fluid inlet connected to the condensing fluid source, a condensate outlet for discharging the portion of the condensable component condensed by the condenser means, an uncondensed process fluid outlet for discharging the portion of the process fluid not condensed by the condenser means, and a condensing fluid outlet for discharging the expended condensing fluid;

means connected to the condensate outlet of the condenser means for discharging the condensate from the system;

a source of atmospheric air;

jet diffuser means having a suction inlet connected to the uncondensed process fluid outlet of the condenser means and a motivating fluid inlet connected to the atmospheric air source for mixing the uncondensed process fluid with atmospheric air to dilute the uncondensed process fluid and increase its pressure and for passing the resulting diluted process fluid to an outlet of the jet diffuser means; and liquid ring pump means having a suction inlet connected to the diluted process fluid outlet of the jet diffuser means for further increasing the pressure of the diluted process fluid and for discharging it from the system.

2. The system defined in claim 1 wherein the condensing fluid is a liquid and wherein the condenser means comprises a shell and tube type heat exchanger.

3. The system defined in claim 1 wherein the condensing fluid is water and wherein the system further comprises means for connecting the condensing fluid outlet of the condenser means to the liquid ring pump means so that the expended condensing fluid provides at least part of the seal water supply for the pump.

4. The system defined in claim 3 further comprising means connected to the expended condensing fluid outlet of the condenser means for spraying a portion of the expended condensing fluid into the diluted process fluid prior to the suction inlet of the liquid ring pump means.

5. The system defined in claim 4 further comprising means connected to the source of condensing fluid for spraying condensing fluid which has not passed through the condenser means into the diluted process fluid prior to the suction inlet of the liquid ring pump means.

6. The system defined in claim 1 wherein the condenser means comprises an air-cooled radiator and the condensing fluid is atmospheric air.

7. The system defined in claim 6 wherein the source of atmospheric air connected to the motivating fluid inlet of the jet diffuser means is the expended condensing fluid outlet of the condenser means.

* * * * *